US005260406A

United States Patent [19]

Pechhold

[11] Patent Number: 5,260,406

[45] Date of Patent: Nov. 9, 1993

[54] PHENOLIC STAIN-RESISTS USING MERCAPTOCARBOXYLIC ACID

[75] Inventor: Engelbert Pechhold, Chadds Ford, Pa.

[73] Assignee: E. I. Du Pont de Nemours and Company, Wilmington, Del.

[21] Appl. No.: 868,323

[22] Filed: Apr. 14, 1992

[51] Int. Cl.[5] ..... C08G 8/18; C08G 14/04

[52] U.S. Cl. ..... 528/158; 528/137; 528/145; 528/147; 528/150; 528/161; 252/8.7; 428/96; 428/97

[58] Field of Search ..... 528/137, 150, 129, 147, 528/140, 144, 145, 158, 161; 525/488, 502, 143, 402; 428/96, 97; 252/8.7

[56] References Cited

U.S. PATENT DOCUMENTS

| | | | |
|---|---|---|---|
| 4,501,591 | 2/1985 | Ucci et al. | 8/495 |
| 4,592,940 | 6/1986 | Blyth et al. | 428/96 |
| 4,680,212 | 7/1987 | Blyth et al. | 428/97 |
| 4,833,009 | 5/1989 | Marshall | 428/96 |
| 4,883,839 | 11/1989 | Fitzgerald et al. | 525/136 |
| 4,937,123 | 6/1990 | Chang et al. | 428/96 |
| 4,940,757 | 7/1990 | Moss, III et al. | 525/502 |
| 4,948,650 | 8/1990 | Fitzgerald et al. | 428/96 |
| 4,963,409 | 10/1990 | Liss et al. | 428/96 |
| 5,001,004 | 3/1991 | Fitzgerald et al. | 428/263 |
| 5,015,259 | 5/1991 | Moss, III et al. | 8/115.6 |

OTHER PUBLICATIONS

Massy, D. J. R. & McKillop, A. Carboxyalkylthiomethylation of Phenols, *Synthesis*, 1989, #4, pp. 253-255.

*Primary Examiner*—John Kight, III
*Assistant Examiner*—Richard Lee Jones

[57] ABSTRACT

A stain-resist agent for polyamide fibers, its preparation and use are disclosed. The stain-resist agent is the condensation product of bis-hydroxyphenylsulfone with 0.5 to 1.0 mole of formaldehyde, per mole of bis-hydroxyphenylsulfone, and 0.15 to 1.5 moles of mercaptoacetic acid or mercaptosuccinic acid per mole of bis-hydroxyphenylsulfone and ammonium hydroxide or an alkali metal hydroxide in an amount sufficient to neutralize the mercapto acid plus an excess of about 0.2 to 0.6 mole of hydroxide per mole of bis-hydroxyphenylsulfone. Generally the reaction is carried out at 110° to 180° C. for 1 to 48 hours, with 130° to 160° C. for 3 to 24 hours being preferred. The product is applied to the polyamide fibers from an aqueous bath to provide a coating of 0.5 to 5.0 wt % stain-resist agent. The stain-resist is applied in the presence of a magnesium salt.

9 Claims, No Drawings

PHENOLIC STAIN-RESISTS USING MERCAPTOCARBOXYLIC ACID

FIELD OF THE INVENTION

The present invention relates to polyamide textile substrates rendered stain resistant by treatment with a magnesium salt together with novel base-catalyzed condensation products of bis-hydroxyphenylsulfone(BHPS), formaldehyde and a mercapto carboxylic acid. The stain-resist agents of this invention may be applied at pHs close to neutrality which are less corrosive than, and thus environmentally preferred to many previously known materials.

BACKGROUND OF THE INVENTION

Polyamide substrates, such as nylon carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a barrier such as a highly fluorinated polymer to the substrate. Another is to use stain resists consisting of either phenol-formaldehyde condensates or acrylic acid as well as styrene/maleic acid polymerisates or combination of these. Examples of phenol-formaldehyde condensates are described in U.S. Pat. Nos. 4,501,591, 4,592,940, 4,680,212, 4,833,009 and 4,963,406. These materials are either condensation products of naphthalene monosulfonic acids with BHPS and formaldehyde or condensation products of phenolsulfonic acid with BHPS and formaldehyde. To impart stain resistance and solubility, the presence of sulfonic acid groups is necessary in these compounds. Stain-resists of this type have to be applied below pH of 4.5 , preferably below 3.0. Examples of poly(acrylic acid) type stain-resists are described in U.S. Pat. Nos. 4,940,757 , 5,015,259 and EUR 332,342, and of styrene/maleic acid type stain-resists in U.S. Pat. Nos. 4,883,839, 4,948,650, and 5,001,004. Stain-resists of this type have to be applied below pH of 3.0, preferably below 2.5.

Applications of stain-resists at low pH's cause corrosion of equipment and safety as well as environmental problems. Therefore, the ability of a stain-resist to function in a neutral or close to neutral environment is highly desirable. The use of mercapto acids instead of sulfonic acids in the condensation of BHPS and formaldehyde is quite different from the prior art. The synthesis of monomeric carboxyalkylthiomethylated phenols has been described in Synthesis(April 1989, page 253). These materials have no stain-resist properties. The synthesis of the stain-resists described in this invention when carried out above 100° C. and at specific molar ratios leads to unique and unexpected properties.

BRIEF SUMMARY OF THE INVENTION

The present invention provides stain resistant polyamide fibrous substrates by treatment with a magnesium salt together with a water-soluble or water-dispersible base-catalyzed condensation products of BHPS, formaldehyde and a mercapto carboxylic acid, and methods for preparing the above condensation products. The stain-resist agents of this invention are less sensitive to pH of application than some previously known materials. They may be applied at higher pHs which are less corrosive and more environmentally preferred.

DETAILED DESCRIPTION OF INVENTION

The present invention relates to water-soluble or water dispersible base-catalyzed condensation products of BHPS, formaldehyde and a mercapto acid, useful as stain-resist agents for fibrous polyamides. BHPS is the only phenolic suitable for use in this invention. Formaldehyde is the only aldehyde suitable for use in this invention. Mercaptoacetic and mercaptosuccinic acids are the only mercapto acids suitable for use in this invention. Mercaptoacetic acid is preferred; results with mercaptosuccinic acid being marginal. Alkalies suitable for use in this invention are the hydroxides of sodium, potassium, lithium and ammonia.

Reaction of the above ingredients are carried out in aqueous media using selected mole ratios to obtain the useful condensates of this invention:

| | Moles Per Mole of BHPS | |
|---|---|---|
| | Suitable | Preferred |
| Formaldehyde | 0.5–1.0 | 0.75 |
| Mercapto acid | 0.15–1.5 | 0.4–1.1 |
| Alkali(-acid)* | 0.2–0.6 | 0.4 |

*This term is defined as the amount of alkali to be used in addition to the amount required to neutralize the mercapto acid.

The condensations of this invention are carried out at temperatures of about 110°–180° C., with temperatures of 130°–160° C. preferred, for 1–48 hours, with from 3–24 hours being preferred. There is no need to control the pressure of the reaction mass; autogenous pressures are satisfactory.

The structures of the condensates of this invention have not been defined. Molecular weight studies using gel permeation chromatography indicate species with molecular weights of less than 1,000. The relatively low molecular weights may be connected to the fact that it is necessary to incorporate a magnesium salt in the application bath if stain resistance is to be attained.

The condensates of this invention can be used, together with a magnesium salt, in treating polyamide textile substrates. The magnesium salts used in this invention can be any of the common water soluble magnesium compounds such as magnesium acetate, chloride, nitrate, sulfate, etc. The condensates of this invention can be effectively applied to polyamide fibrous substrates by a wide variety of methods known to those skilled in the art, such as: padding, spraying, foaming in conjunction with foaming agents, batch exhaust in beck dyeing equipment, or continuous exhaust during a continuous dyeing operation.

They can be applied by such methods to dyed or undyed polyamide textile substrates. In addition, they can be applied to such substrates in the absence or presence of a polyfluoroorganic oil-, water-, and/or soil repellent materials. In the alternative, such a polyfluoroorganic material can be applied to the textile substrate before or after application of the polymers of this invention thereto.

The quantities of the compositions of this invention which are applied to the textile substrate, are amounts effective in imparting stain-resistance to the substrate. Those amounts can be varied widely. In general, one can use between 0.5 and 5% by weight of condensates based on the weight of the textile substrate. Usually 2.5% by weight or less is used. The amounts of magnesium salts required range from about 0.5% based on the weight of fiber to about 7%.

The condensates of this invention, together with a magnesium salt, can be applied at pHs ranging between about 4 and 8 with the range of 5 to 7 being preferred. More effective stainblocking is obtained if the condensates are applied to the textile substrate at either 20° C. followed by heat treatment at a temperature in the range between about 50° and 100° C. for about 1 to 60 minutes, or applied at temperatures in the range between about 40° and 95° C. for about 1 to 60 minutes. For example, at a pH between about 5 and 8, a temperature between about 70° and 90° C. is preferred. However, stain-blocking can be obtained when application is effected even at the temperature of cold tap water (10°-15° C.).

The compositions of this invention can also be applied in-place to polyamide carpeting which has already been installed in a dwelling place, office or other locale. They can be applied as a simple aqueous preparation or in the form of an aqueous shampoo preparation, with or without one or more polyfluoro organic oil-, water-, and/or soil-repellent materials.

The following Examples are given to illustrate the invention, not to limit it.

Example 1

(Molar ratio: 1 BHPS, 0.8 MA, 1.55 $CH_2O$, 1.2 total NaOH, 0.4 -Acid NaOH)

Into a 400 ml 316-stainless steel shaker tube was charged 66.7 g, 267 mmoles, of BHPS; 20.68 g, 213 mmoles, of 95% mercaptoacetic acid; 33.52 g, 413 mmoles, of 37% formaldehyde; 42.84 g, 321 mmoles, of 30% sodium hydroxide and 160 ml of water. The air in the tube was replaced by nitrogen before closing the tube. The reactants were then heated with shaking to 150° C. and held for 12 hours at this temperature under autogenous pressure, during which time, the pressure reached a maximum of 90 psig (620 kPa). The tube was then cooled to room temperature and discharged after release of pressure. The product was a malodorous liquid of pH 7.4. The odorous material was removed by steam distillation to give a straw-colored liquid.

Examples 2 through 8 are carried out in a manner similar to Example 1.

| | Moles per mole of BHPS | | | | Reaction | | |
|---|---|---|---|---|---|---|---|
| Ex. | Mercapto | | NaOH | | Time | Temp. | |
| No. | Acid | $CH_2O$ | Total | -Acid* | hrs | °C. | Notes |
| 2 | 0.5 MA | 1.25 | 0.9 | 0.4 | 24 | 120 | A |
| 3 | 0.5 MA | 1.25 | 0.9 | 0.4 | 24 | 150 | |
| 4 | 0.5 MA | 1.25 | 0.7 | 0.2 | 24 | 150 | A |
| 5 | 0.5 MA | 1.25 | 1.1 | 0.6 | 24 | 150 | A |
| 6 | 1.0 MA | 1.5 | 1.4 | 0.4 | 24 | 150 | A |
| 7 | 0.5 MA | 1.25 | 0.9 | 0.4 | 24 | 170 | A,B |
| 8 | 0.15 MA | 0.9 | 0.55 | 0.4 | 24 | 150 | A,B |
| 9 | 0.4 MS | 1.15 | 1.2 | 0.4 | 24 | 150 | A |

*This term indicates the amount of alkali used in addition to the amount needed to neutralize the mercapto acid.
MA = mercaptoacetic acid, MS = mercaptosuccinic acid
Note A: The steam distillation is omitted.
Note B: The product is a solid.

Evaluation Method

Nylon fiber was treaded with 1.2% stain-resist solution whose pH was adjusted to the desired value with either citric acid or sodium carbonate. The treatment was at a goods-to-liquor ratio of 1:32 for 45 minutes at 95° C. When $MgSO_4$ was used, it was added with the stain-resist at 5% owf. The fiber was then washed, air-dried at room temperature, and exposed to a dye solution consisting of 0.2 g FD&C Red Dye No. 40 and 3.2 g citric acid in 1 liter of distilled water at a goods-to-liquor ratio of 1:40. After approximately 65 hours, the dye adsorbed onto the fiber was determined at a wavelength of 498-502 nm by comparing the absorbance with that of the control. Thus a number of 90 means 90% of the dye has been adsorbed, indicating little stain resistance to the acid dye. The lower the number, the better was the resistance to stain.

The following table contains the results of this evaluation method when run on the various products whose preparations are described above.

| | Percent Dye Adsorbed | | | | | | | | |
|---|---|---|---|---|---|---|---|---|---|
| | pH | | | | | | | | |
| Ex. | 3 | 4 | 5 | 7 | 5 Mg | 6 Mg | 7 Mg | 8 Mg | 9 Mg |
| 1 | — | — | — | — | 11 | 2 | 2 | 3 | — |
| 2 | 79 | — | — | — | 78 | 24 | 3 | — | |
| 3 | 66 | — | 60 | — | 60 | 20 | 1 | 1 | 7 |
| 4 | 88 | — | 87 | 91 | 87 | 74 | 8 | 4 | — |
| 5 | 89 | — | 84 | — | 85 | 54 | 4 | 3 | — |
| 6 | 78 | — | — | 92 | 3 | 4 | 5 | 9 | — |
| 7 | — | | — | — | 87 | 79 | 2 | 1 | — |
| 8 | 90 | — | 88 | — | 90 | 90 | 87 | 6 | 2 |
| 9 | 88 | — | 86 | — | 87 | 88 | 88 | 7 | — |

Mg indicates $MgSO_4$ was added.

I claim:

1. A composition useful as a stain-resist agent for polyamide fibers when applied with a magnesium salt, which consist essentially of the condensation product of bis-hydroxyphenylsulfone and about 0.5 to 1.0 moles of formaldehyde per mole of bis-hydroxyphenylsulfone and about 0.15 to 1.5 moles of a mercaptocarboxylic acid per mole of bis-hydroxyphenylsulfone and ammonium hydroxide or an alkali metal hydroxide in an amount sufficient to neutralize the mercapto acid plus an excess of about 0.2 to 0.6 mole of hydroxide per mole of bis-hydroxyphenylsulfone which are condensed at about 110° to 180° C., for about 1 to 48 hours.

2. The composition of claim 1 wherein the mercaptocarboxylic acid is mercaptoacetic acid or mercaptosuccinic acid.

3. The composition of claim 2 wherein from 0.4 to 1.1 moles of mercaptocarboxylic acid per mole of bis-hydroxyphenylsulfone is present.

4. A process for producing the composition of claim 1 comprising reacting bis-hydroxyphenylsulfone with 0.5-1.0 mole of formaldehyde per mole of bis-hydroxyphenylsulfone, about 0.15 to 1.5 moles of a mercaptocarboxylic acid, and sufficient ammonium hydroxide or alkali metal hydroxide to neutralize the mercaptocarboxylic acid and afford an excess of about 0.2 to 0.6 moles of hydroxide per mole of bis-hydroxyphenylsulfone at 110° to 180° C., for about 1 to 48 hours.

5. The process of claim 4 wherein the mercaptocarboxylic acid is mercaptoacetic acid or mercaptosuccinic acid.

6. The process of claim 5 wherein from 0.4 to 1.1 moles of mercaptocarboxylic acid per mole of bis-hydroxyphenylsulfone is present.

7. The process of claim 6 wherein the reaction is carried out at from 130° to 160° C.

8. The process of claim 7 wherein the reaction is carried out for from 3 to 24 hours.

9. The process of claim 8 wherein the mercaptocarboxylic acid is mercaptoacetic acid.

* * * * *